US008719992B2

(12) United States Patent
Wang

(10) Patent No.: US 8,719,992 B2
(45) Date of Patent: May 13, 2014

(54) PAINT ROLLER WITH AN END-SURFACE BLOCKING PIECE

(76) Inventor: Kai Wang, Taichung (TW)

( * ) Notice: Subject to any disclaimer, the term of this patent is extended or adjusted under 35 U.S.C. 154(b) by 305 days.

(21) Appl. No.: 13/196,236

(22) Filed: Aug. 2, 2011

(65) Prior Publication Data

US 2013/0032087 A1 Feb. 7, 2013

(51) Int. Cl.
*B05C 1/08* (2006.01)
*B05C 17/02* (2006.01)

(52) U.S. Cl.
CPC ..... *B05C 17/0222* (2013.01); *B05C 17/0225* (2013.01)
USPC ..... 15/230.11; 15/248.2; 118/264; 118/504

(58) Field of Classification Search
CPC ..... B05C 17/0222; B05C 17/0225
USPC ..... 15/230.11, 248.2; 492/13, 19; 118/264, 118/504, 505
See application file for complete search history.

(56) References Cited

U.S. PATENT DOCUMENTS

| | | | | |
|---|---|---|---|---|
| 5,623,740 | A * | 4/1997 | Burns et al. | 15/230.11 |
| 6,925,674 | B2 * | 8/2005 | Prince et al. | 15/230.11 |
| 7,340,796 | B2 * | 3/2008 | Pyles | 15/114 |
| 2002/0194691 | A1 * | 12/2002 | Meyer | 15/230.11 |

* cited by examiner

*Primary Examiner* — Laura Edwards

(57) ABSTRACT

A paint roller with an end-surface blocking piece, wherein the end-surface blocking piece is formed with a blocking groove to prevent paint from overflowing to the surface of a wall that doesn't need to be painted. Besides, the user doesn't have to turn the end-surface blocking piece when painting different surfaces of a wall in different directions since the end-surface blocking piece is round-shaped.

1 Claim, 7 Drawing Sheets

PAINT ROLLER WITH AN END-SURFACE BLOCKING PIECE

BACKGROUND OF THE INVENTION

1. Field of the Invention

The present invention relates to a paint roller, and more particularly to a paint roller with an end-surface blocking piece to prevent paint from overflowing to the surface of a wall that doesn't need to be painted.

2. Description of the Prior Art

Referring to FIGS. 1-3, a conventional paint roller 10 comprises a handle 11 and a roller 12 moveably mounted on the handle 11. When the paint roller 10 is used to paint a wall X with a right angle, the end surface and the peripheral surface of the roller 12 will be in contact with the two surfaces that define the right angle of the wall. Therefore, an end-surface blocking assembly 13 is pivoted to a side handle 14 to prevent the end surface of the roller 12 from contacting the wall X.

The end-surface blocking assembly 13 comprises a first and second pieces 131, 132 which are connected and pivoted to the side handle 14 by a pivot 133. One side of the end-surface blocking assembly 13 is a flat and straight abutting surface 134 which is pressed against the wall X to prevent the paint from the end surface of the paint roller 10 from painting on the wall X. Another side of the end-surface blocking assembly 13 is provided with an elastic pressing member 135 which is pressed to bring the roller 12 into closer contact with the wall X. However; to change the blocking direction of the end-surface blocking assembly 13 with respect to the wall X, it has to turn the direction of the roller, and then it has to turn the end-surface blocking assembly 13, as shown in FIGS. 2 and 3, to make the abutting surface 134 of the end-surface blocking assembly 13 press against the wall X. Therefore, this type of paint roller 10 is inconvenient to use. Furthermore, the end-surface blocking assembly 13 has too many components and is difficult to assemble, which increases the production cost.

On top of that, since one side of the end-surface blocking assembly 13 is a flat and straight abutting surface, so that when liquid paint accumulates to a certain level on the end-surface blocking assembly 13, it is likely to overflow to the surface of the wall X that the end-surface blocking assembly 13 presses against.

The present invention has arisen to mitigate and/or obviate the afore-described disadvantages.

SUMMARY OF THE INVENTION

The primary object of the present invention is to provide a paint roller with an end-surface blocking piece capable of preventing paint from overflowing to the surface of a wall that doesn't need to be painted. Besides, user doesn't have to turn the end-surface blocking piece when painting different surfaces of a wall in different directions.

To achieve the above object, a paint roller with an end-surface blocking piece in accordance with the present invention comprises: a handle, a mounting stem, a roller, an elastic connecting device and an end-surface blocking piece. The mounting stem is disposed at one end of the handle and includes an extension portion and a pivot, the extension portion has one end connected to the handle and another end connected to the pivot, and a side piece is connected to a side of the extension portion. The roller is rotatably sleeved on the pivot of the mounting stem. The elastic connecting device includes an elastic piece made of metal and a connecting seat, the elastic piece has one end connected to the side piece of the mounting stem and another end connected to one end of the connecting seat. The end-surface blocking piece is pivoted to another end of the connecting seat and includes a blocking portion connected to an arm portion, and the end-surface blocking piece is rotatable with respect to the roller.

It is characterized in that: the blocking portion is a round sheet structure including an inner surface and an outer surface, around the periphery of the outer surface is formed a blocking groove, the arm portion has one end connected to a periphery of the blocking portion, and the inner surface of the blocking portion faces toward the end surface of the roller.

Since the end-surface blocking piece is round, when painting the surfaces at different directions of the wall, the user doesn't have to change the angle or position of the end-surface blocking piece, it is vey convenient. Furthermore, the paint can be prevented by the blocking groove from overflowing to the surface of the wall that should not be painted.

DETAILED DESCRIPTION OF THE PREFERRED EMBODIMENTS

Figure 1:
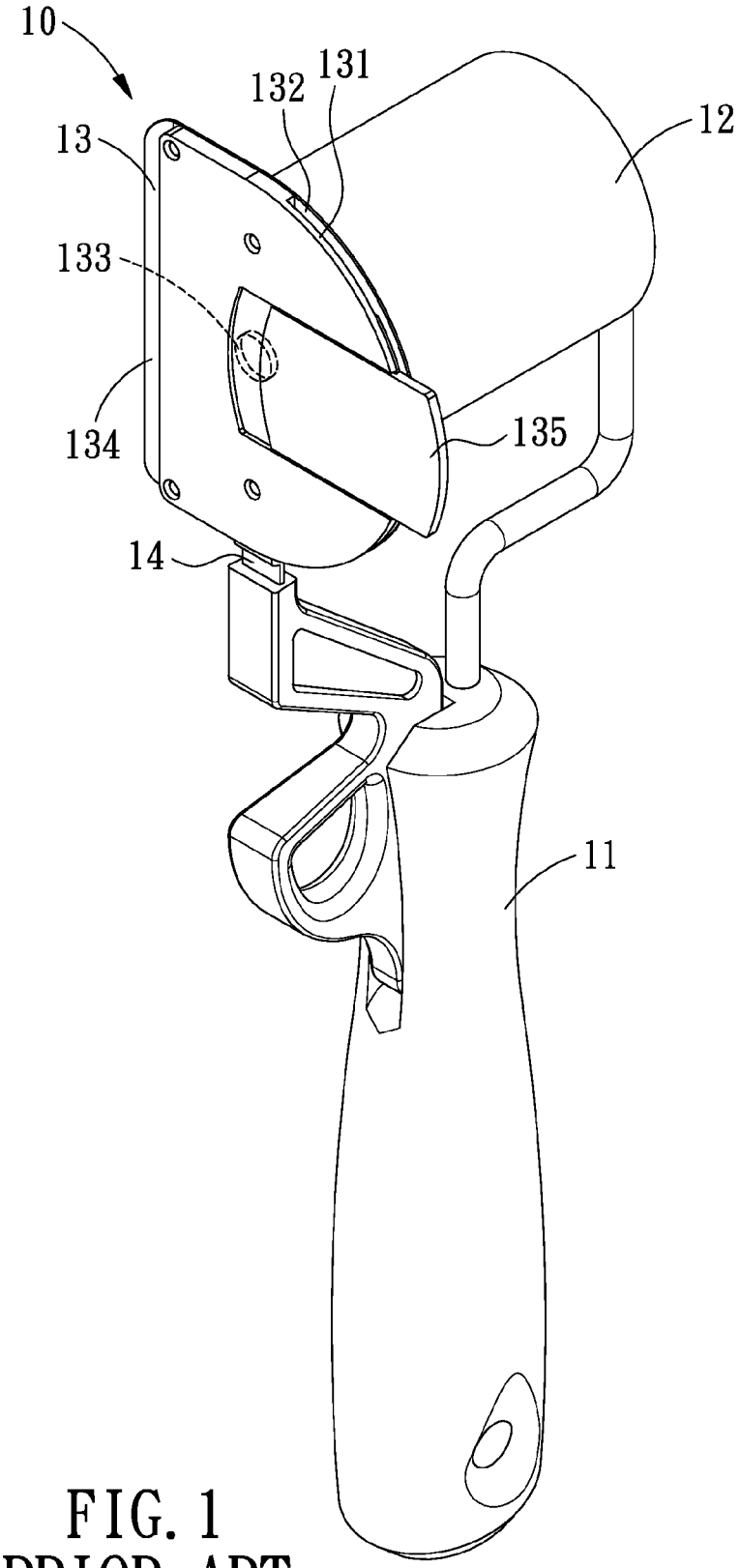
FIG. 1 PRIOR ART
FIG. 1 is a perspective view of a conventional paint roller.
Figure 2:
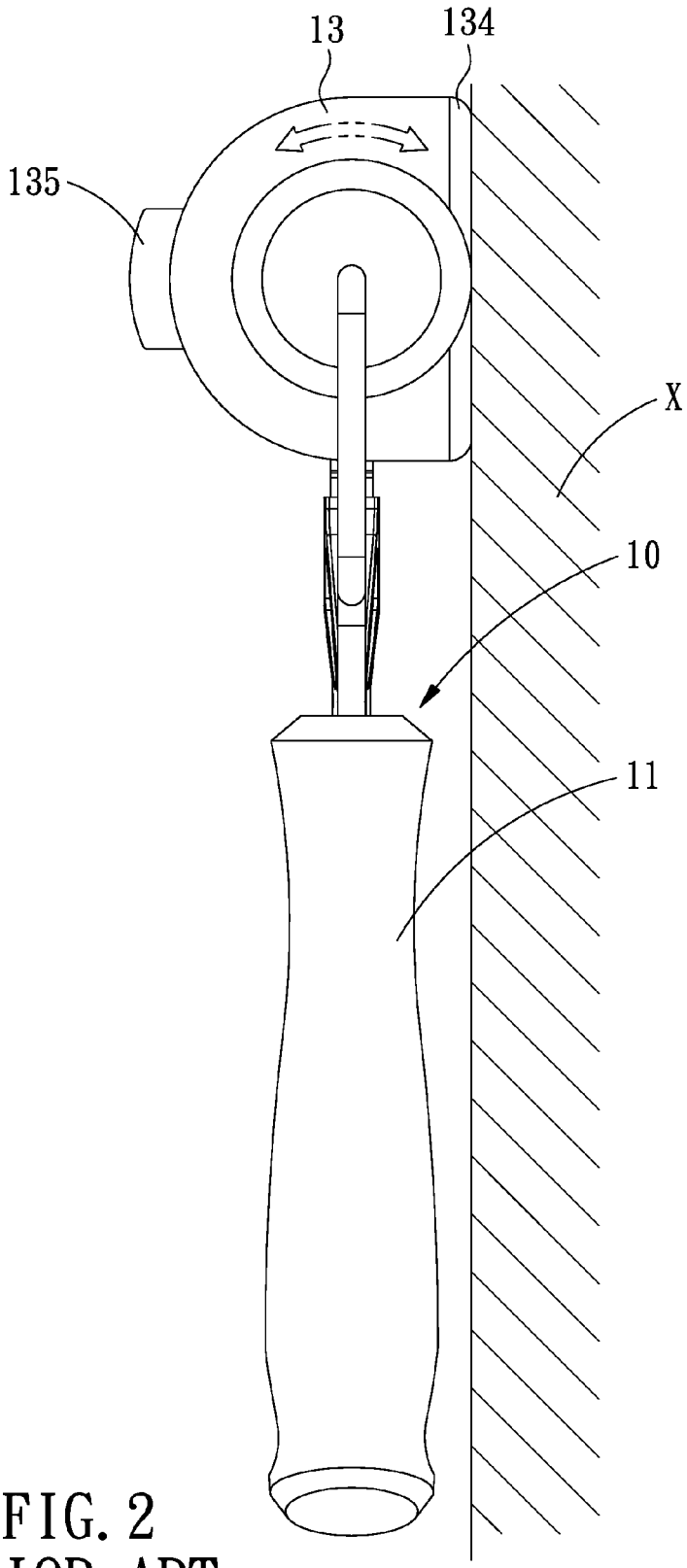
FIG. 2 PRIOR ART
FIG. 2 is an operational view of the conventional paint roller.
Figure 3:
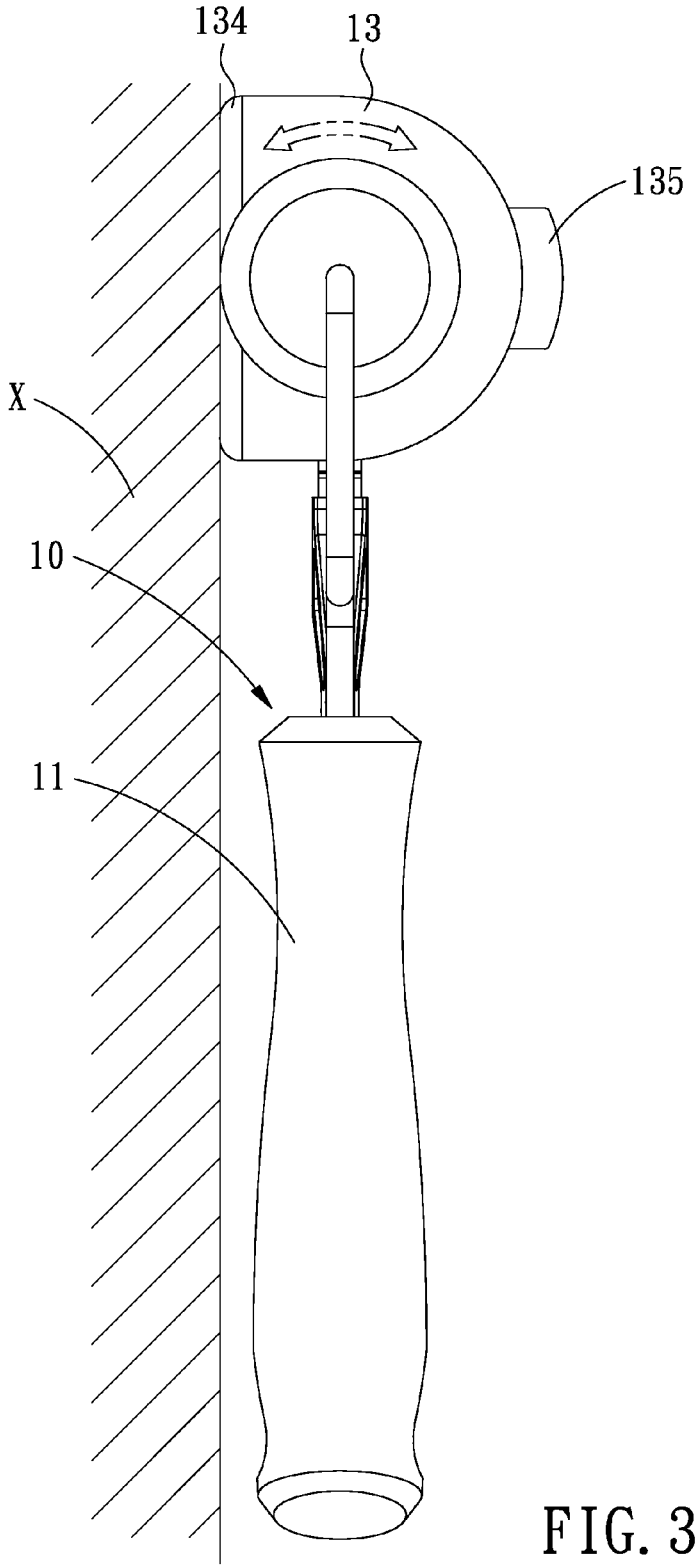
FIG. 3 PRIOR ART
FIG. 3 is another operational view of the conventional paint roller.
Figure 4:
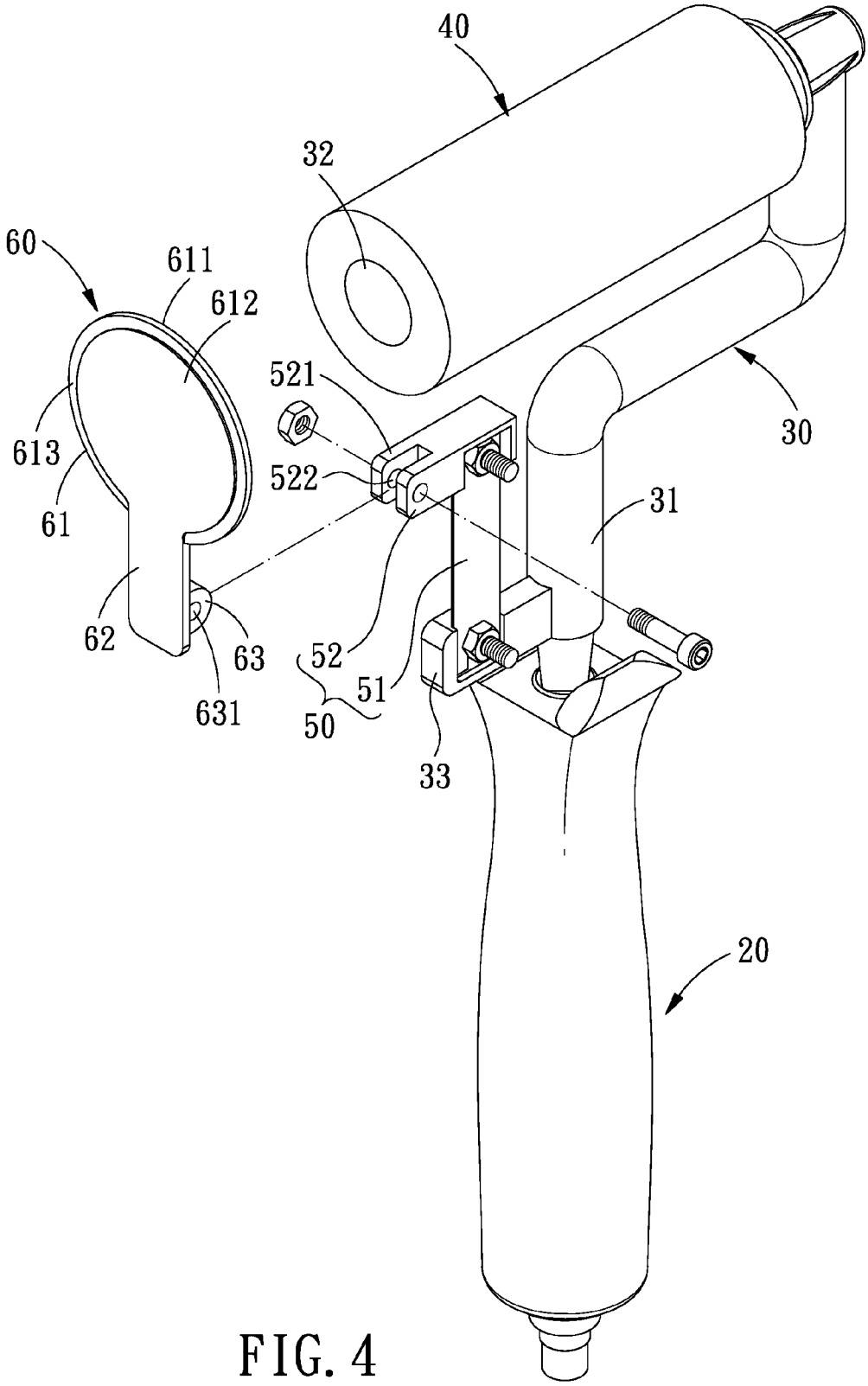
FIG. 4 is an exploded view of a painter roller with an end-surface blocking piece in accordance with the present invention.
Figure 5:
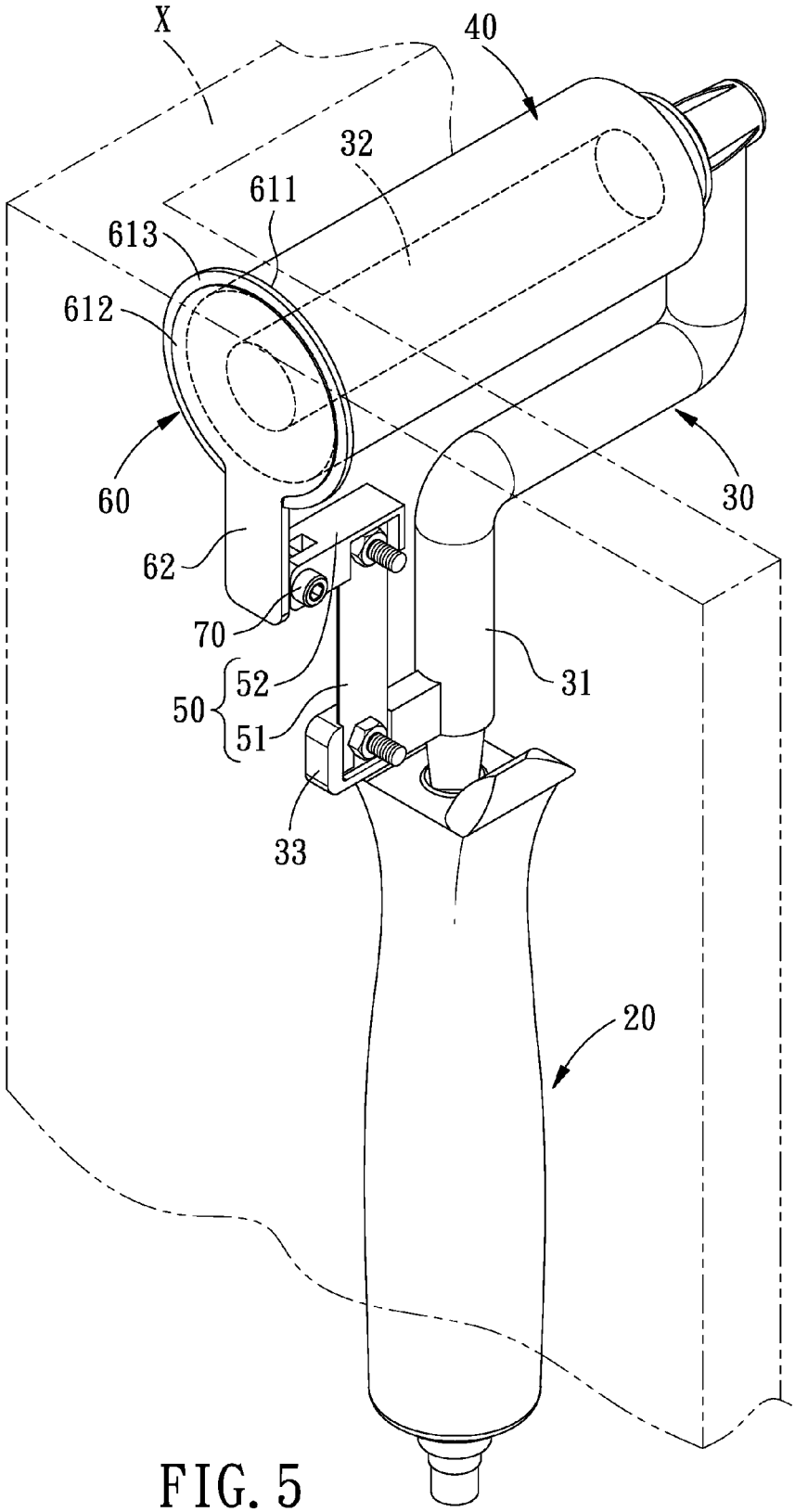
FIG. 5 shows that the painter roller with an end-surface blocking piece in accordance with the present invention is used to paint a right-angle corner of a wall.
Figure 6:
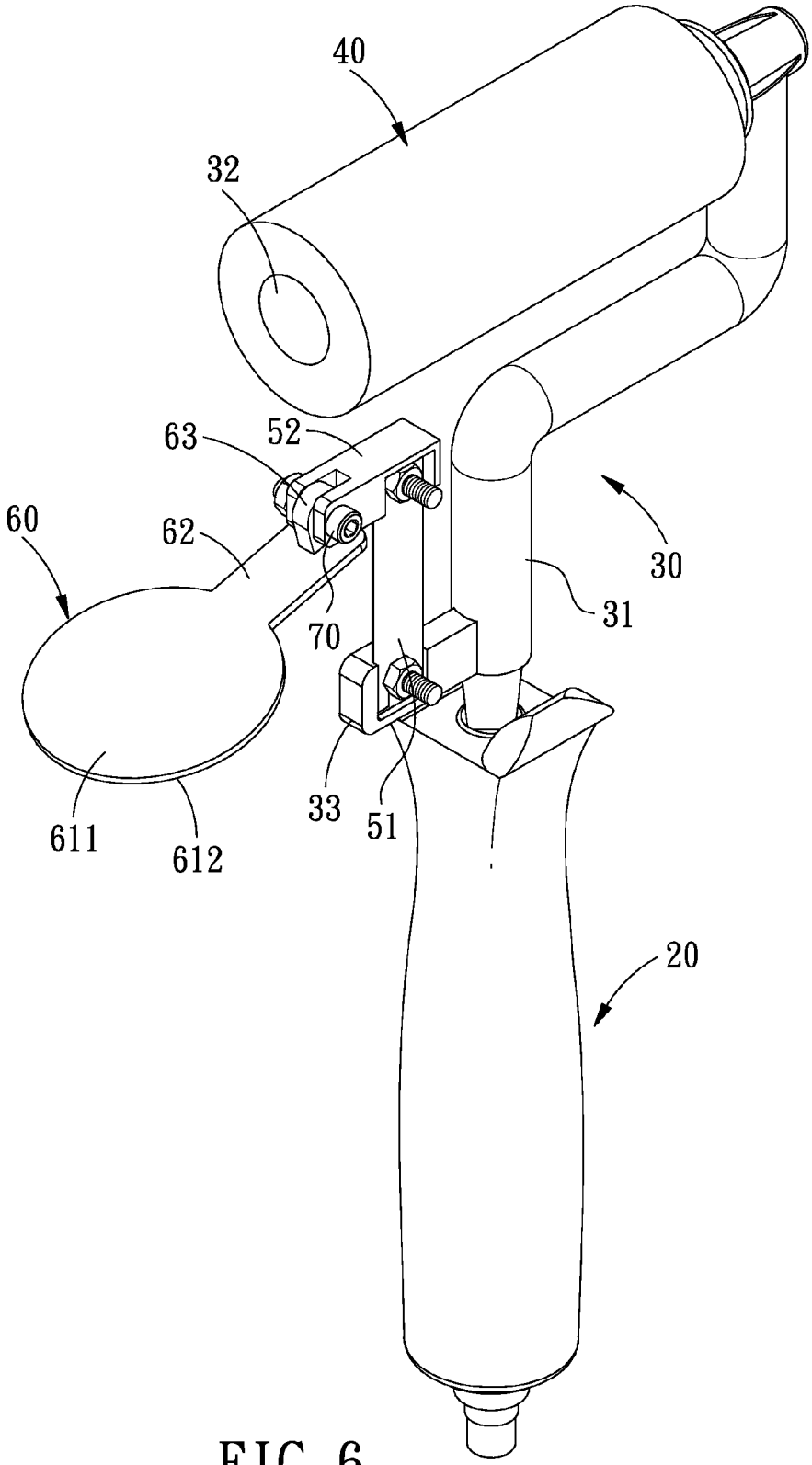
FIG. 6 shows that the end-surface blocking piece of the painter roller in accordance with the present invention is turned aside.

The present invention will be clearer from the following description when viewed together with the accompanying drawings, which show, for purpose of illustrations only, the preferred embodiment in accordance with the present invention.

Referring to FIGS. 4-7, a paint roller with an end-surface blocking piece in accordance with the present invention comprises: a handle 20, a mounting stem 30, a roller 40, an elastic connecting device 50 and an end-surface blocking piece 60.

The mounting stem 30 is disposed at one end of the handle 20 and includes an extension portion 31 and a pivot 32 that extend in two different directions vertical to each other. The extension portion 31 has one end connected to the handle 20 and another end connected to the pivot 32, and to a side of the extension portion 31 is connected a side piece 33.

The roller 40 is rotatably sleeved on the pivot 32 of the mounting stem 30.

The elastic connecting device 50 includes an elastic piece 51 made of metal and a connecting seat 52. The elastic piece 51 has one end connected to the side piece 33 of the mounting stem 30 and another end connected to one end of the connecting seat 52. Another end of the connecting seat 52 is provided with two opposite ears 521 each of which is formed with an assembling hole 522.

The end-surface blocking piece 60 includes a blocking portion 61, an arm portion 62 and a pivoting portion 63 sequentially connected one another. The blocking portion 61 is a round sheet structure including an inner surface 611 and an outer surface 612, and around the periphery of the outer surface 612 is formed a blocking groove 613. The arm portion 62 has one end connected to the periphery of the blocking portion 61, and the pivoting portion 63 is connected to another end of the arm portion 62. The pivoting portion 63 is formed with a pivoting hole 631 and received between the two ears 521 of the connecting seat 52 in such a manner that the pivoting hole 631 of the pivoting portion 63 is aligned with the assembling holes 522 of the ears 521, and then a screw 70 is inserted through the pivoting hole 631 of the pivoting portion 63 and the assembling holes 522 of the ears 521 to pivotally connect the end-surface blocking piece 60 and the elastic connecting device 50. The inner surface 611 of the blocking portion 61 faces the end surface of the roller 40, and the end-surface blocking piece 60 is rotatable relative to the roller 40.

When the roller 40 is used to paint the wall X with a right angle, the outer surface 612 of the blocking portion 61 of the end-surface blocking piece 60 faces toward the surface of the wall X that needs not be painted. The elastic piece 51 provides elasticity for the elastic connecting device 50 and the end-surface blocking piece 60, so that the roller 40 can be pressed more closely against the wall X.

Figure 7:
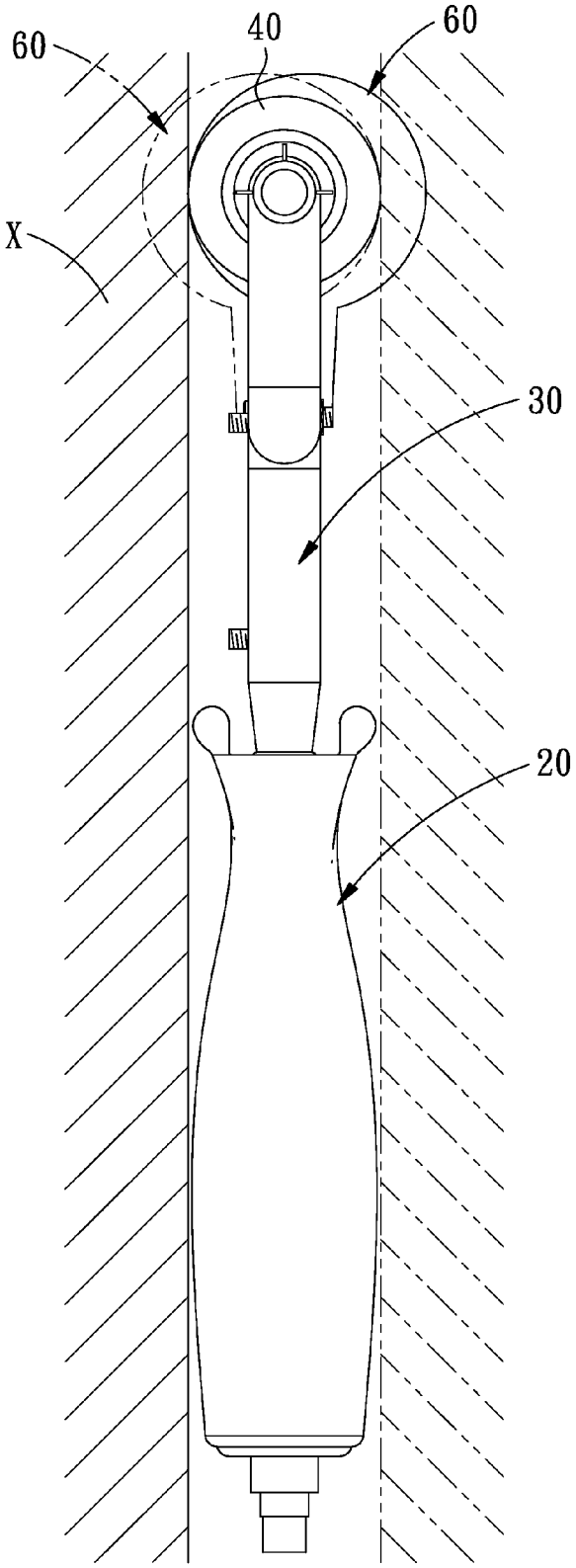
FIG. 7 is an operation view of the painter roller with an end-surface blocking piece in accordance with the present invention.

Since the blocking portion 61 of the end-surface blocking piece 60 is round, namely, the periphery of the end-surface blocking piece 60 is arc-shaped, when painting the surfaces at different directions of the wall X, as shown in FIG. 7, the user only needs to press the roller 40 to against the needs-to-be-painted surface of the wall X without having to change the angle or position of the end-surface blocking piece 60, it is vey convenient.

Since it doesn't has to change the angle or position of the end-surface blocking piece 60, plus the end-surface blocking piece 60 is a single piece, it can be easily assembled to the connecting seat 52 of the elastic connecting device 50 simply by the screw 70, which can save material cost and production cost.

Furthermore, since the outer surface 612 of the blocking portion 61 of the end-surface blocking piece 60 is directly abutted against the wall X, and around the periphery of the outer surface 612 is formed the blocking groove 613, paint can be prevented by the blocking groove 613 from overflowing to the surface of the wall X that should not be painted.

While we have shown and described various embodiments in accordance with the present invention, it is clear to those skilled in the art that further embodiments may be made without departing from the scope of the present invention.

What is claimed is:

1. A paint roller with an end-surface blocking piece comprising:

a handle;

a mounting stem disposed at one end of the handle and including an extension portion and a pivot, the extension portion having one end connected to the handle and another end connected to the pivot, and a side piece being connected to a side of the extension portion;

a roller rotatably sleeved on the pivot of the mounting stem;

an elastic connecting device including an elastic piece made of metal and a connecting seat, the elastic piece having one end connected to the side piece of the mounting stem and another end connected to one end of the connecting seat;

an end-surface blocking piece pivoted to another end of the connecting seat and including a blocking portion connected to an arm portion, and the end-surface blocking piece being rotatable with respect to the roller;

characterized in that:

the blocking portion is a round sheet structure including an inner surface and an outer surface, around the periphery of the outer surface is formed a blocking groove, the arm portion has one end connected to a periphery of the blocking portion, and the inner surface of the blocking portion faces toward the end surface of the roller;

the connecting seat is provided with two opposite ears each of which is formed with an assembling hole, the end-surface blocking piece further includes a pivoting portion pivoted to another end of the arm portion, the pivoting portion is formed with a pivoting hole and received between the two ears of the connecting seat in such a manner that the pivoting hole of the pivoting portion is aligned with the assembling holes of the ears, and then a screw is inserted through the pivoting hole of the pivoting portion and the assembling holes of the ears to pivotally connect the end-surface blocking piece and the elastic connecting device.

* * * * *